United States Patent [19]

Panaro

[11] 4,414,526

[45] Nov. 8, 1983

[54] ELECTRIC FUSE HAVING COMPOSITE FUSIBLE ELEMENT

[75] Inventor: Robert J. Panaro, Byfield, Mass.

[73] Assignee: Gould Inc., Rolling Meadows, Ill.

[21] Appl. No.: 321,958

[22] Filed: Nov. 16, 1981

Related U.S. Application Data

[63] Continuation of Ser. No. 62,434, Jul. 30, 1979, abandoned.

[51] Int. Cl.[3] ..... H01H 85/60

[52] U.S. Cl. ..... 337/163; 337/166; 337/292; 337/295

[58] Field of Search ..... 337/159, 160, 163–166, 337/228, 229, 231, 232, 248, 252, 253, 276, 292, 295, 296

[56] References Cited

U.S. PATENT DOCUMENTS

| | | | |
|---|---|---|---|
| 3,020,372 | 2/1962 | Kozacka | 337/276 |
| 3,140,371 | 7/1964 | Johann et al. | 337/296 |
| 3,523,265 | 8/1970 | Feenan et al. | 337/295 |

FOREIGN PATENT DOCUMENTS

| | | | |
|---|---|---|---|
| 1213736 | 11/1970 | United Kingdom | 337/292 |

*Primary Examiner*—William H. Beha, Jr.

*Attorney, Agent, or Firm*—Frederick A. Goettel, Jr.

[57] ABSTRACT

An electric low-voltage current-limiting fuse completely or substantially complying with the Underwriters Laboratories Inc. Standard Class R fuses. The current carrying part of the fuse comprises a fusible element having serially arranged perforations. This part may be of silver or of copper. The current carrying part of the fuses further comprises tabs of copper bent over the rims of the casing and conductively interconnecting the ends of the fusible element with the terminal caps of the fuse. The fusible element is provided with an M-effect metal to limit the temperature rise of the fusible element and of the casing. The tabs are considerably thicker than the fusible element. If the fusible element is of silver the thickness of the tabs of copper is larger than the thickness required to fully compensate for their higher resistivity. The ratio of the thickness of a pair of tabs of copper to the thickness of a fusible element of silver depends upon the geometrical configuration of the latter and is in the range of 2:1 to somewhat less than 5:1. Since the tabs are thicker than the fusible element both cannot be joined by conventional rolling operations. Each of the pair of tabs is formed by a part separate from the fusible element. These tabs are affixed by electroconductive bonds such as, e.g. spot-welds, to the fusible element.

10 Claims, 16 Drawing Figures

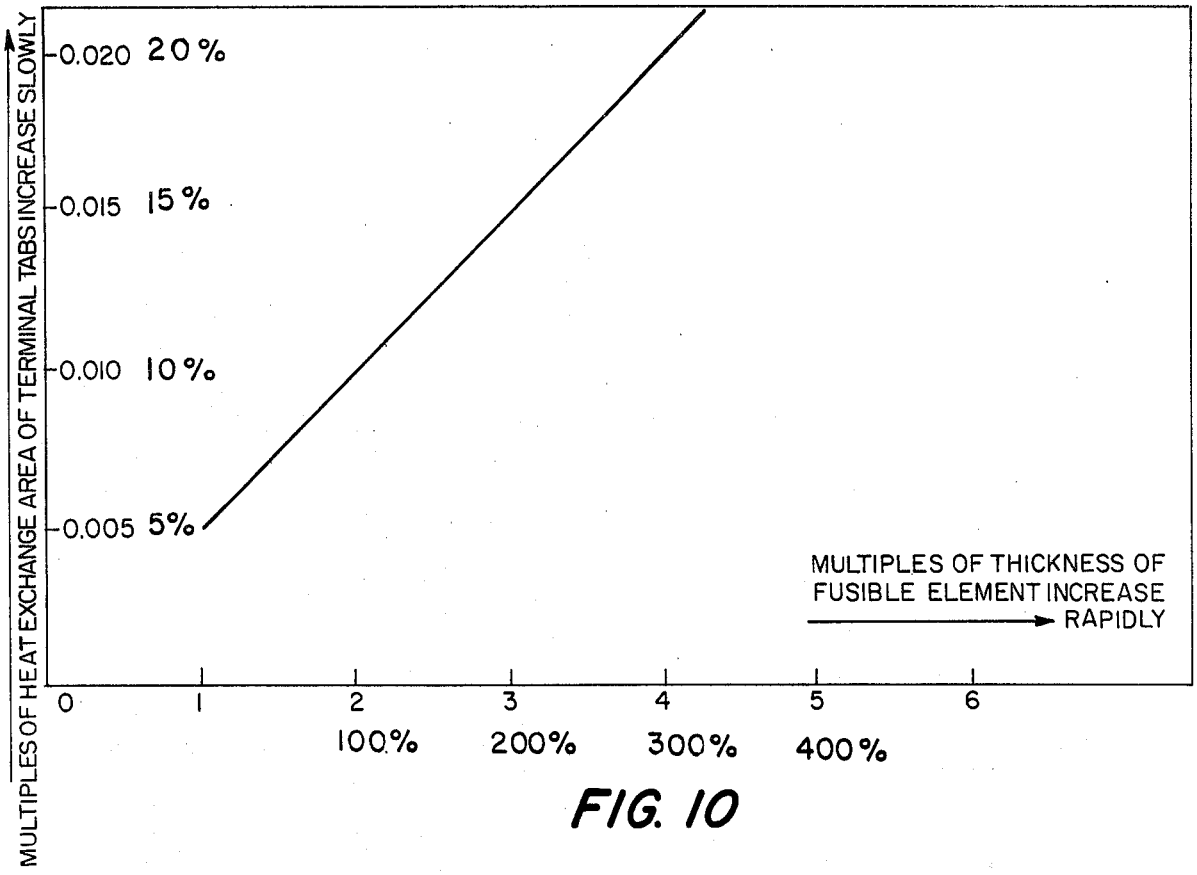
FIG. 10
FIG. 10a
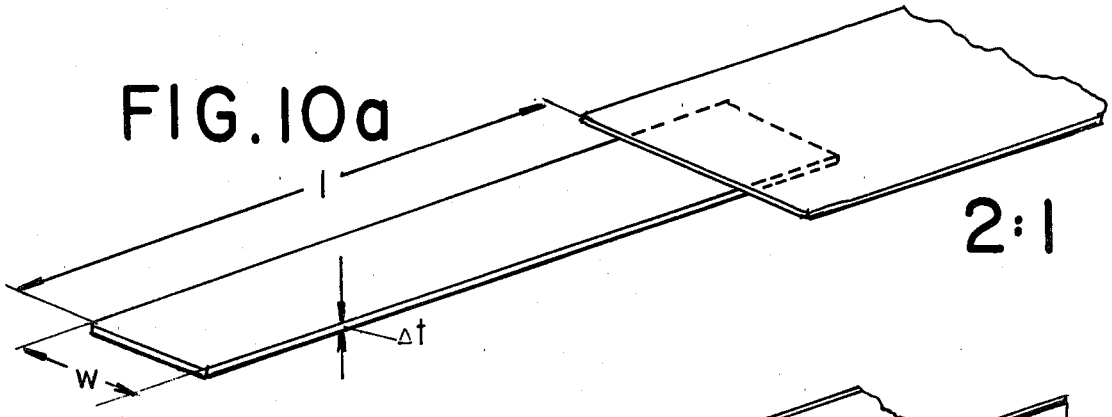
FIG. 10b
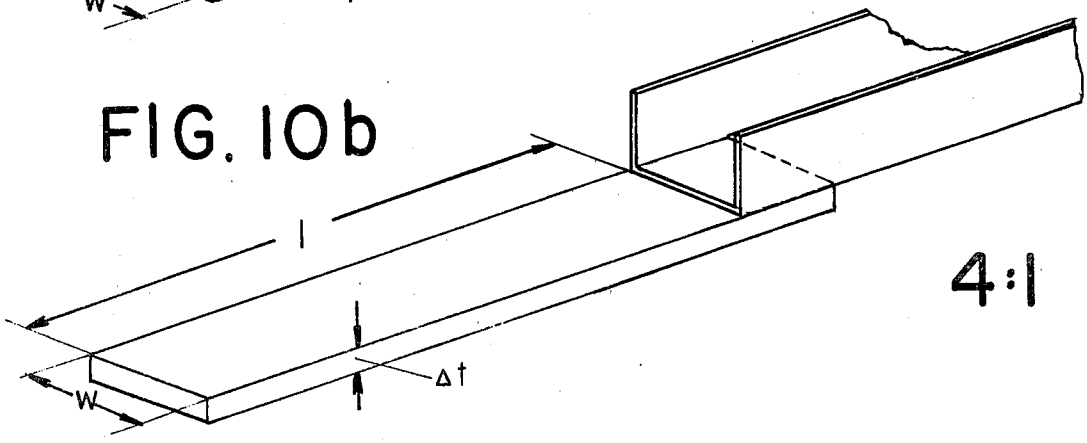

ELECTRIC FUSE HAVING COMPOSITE FUSIBLE ELEMENT

This application is a continuation of application Ser. No. 62,434, filed July 30, 1979, now abandoned.

The application shows in detail fuses having fusible elements of silver and tabs of copper. With the rising price of silver it may be necessary to substitute for the fusible elements of silver fusible elements of copper. At the present time silver is, however, the preferred metal for the fusible element proper.

In this application silver and copper have been designated by the generic term current-limiting metals. Virtually all current-limiting fuses manufactured at this time have fusible elements of either copper, or silver. The reason for this fact is that silver and copper have close pre-arcing $I^2 \cdot t$ values, that of silver being $8.00 \times 10^8$ ohm/cm, and that of copper $11.72 \times 10^8$ ohm/cm.

The invention further comprises electric fuses having two terminals, but wherein only one terminal is a relatively thick tab of copper that is conductively bonded to a relatively thin fusible element of silver or of copper.

As mentioned above, it is one object of this invention to provide fuses capable of complying, or substantially complying, with the time-current curves of Underwriters Laboratories Inc. Standard R fuses. An understanding of the invention depends, therefore, on a knowledge of this Standard, generally referred-to in abbreviated forms as UL 198.4. Reference may be had to this Standard, but for the sake of convenience the most important part of it, as far as this invention is concerned, will be recited below.

(1) "5.1 A fuse shall be capable of carrying 110 percent of its rated current indefinitely . . . "

(2) "7.1 A fuse shall clear within the time limit indicated in Table 7.1 . . . "

TABLE 7.1

| | CLEARING TIMES | | |
|---|---|---|---|
| | Max. Clearing Time | | Min. Acceptable Clearing Time for Time Delay Fuses |
| Ampere Rating | 135 Percent Rating | 200 Percent Rating | 500 Percent Rating |
| 0–30 | 60 minutes | 2 minutes | 10 seconds |
| 31–60 | 60 minutes | 4 minutes | 10 seconds |
| 31–100 | 120 minutes | 6 minutes | 10 seconds |
| 101–200 | 120 minutes | 8 minutes | 10 seconds |
| 201–400 | 120 minutes | 10 minutes | 10 seconds |
| 401–600 | 120 minutes | 12 minutes | 10 seconds |

UL 198.4 further specifies maximum acceptable peak let-through currents (Ip) and clearing $I^2 \cdot t$ values. Since this invention may be considered, and indeed is, a change of prior art Class R fuses, which affects the voltage drop along the fuse, the amount of heat generated in the fuse, heat dissipation from its terminal tabs and the ratio of the thickness of the fusible element of silver to that of the terminal tabs of copper, there is no need in this context of considering the UL 198.4 requirements in regard to maximum peak let-through currents and maximum clearing $I^2 \cdot t$ values.

PRIOR ART

The closest prior art known to applicant are the patents identified below:

U.S. Pat. No. 2,781,434 to K. W. Swain; Feb. 12, 1957 for CURRENT-LIMITING FUSES COMPRISING FUSE LINKS OF SILVER AND COPPER U.S. Pat. No. 2,809,257 to K. W. Swain; Oct. 8, 1957 for COMPOSITE FUSE LINKS OF SILVER AND COPPER U.S. Pat. No. 3,543,210 to F. J. Kozacka; Nov. 24, 1970 for CURRENT LIMITING FUSE HAVING FUSE LINK WITH LONGITUDINAL GROOVE U.S. patent application of R. J. Panaro et al; Ser. No. 952,383; filed Oct. 18, 1978 for FUSIBLE ELEMENT FOR TIME-LAG FUSES HAVING CURRENT LIMITING ACTION

BACKGROUND OF THE INVENTION

One of the objects of this invention is to minimize the voltage drop across electric low-voltage fuses, and thus to provide a family of electric low voltage fuses that minimize heat losses and thus conserve electric energy.

To this end the current path of fuses according to this invention comprises a relatively thin center portion having serially arranged perforations, and two terminals of which at least one is in the form of a single tab having a thickness that is considerably larger than the thickness of the fusible element and thus reduces the voltage drop across the fuse. That tab is bent across one of the rims of the casing of the fuse to the outer surface thereof where it is conductively engaged by, or conductively connected with, one of the terminal caps of the fuse. The tab consists of copper, or an alloy thereof, that has a relatively small resistivity, and the center portion of the fusible element is either of silver or of copper, i.e. of a current-limiting metal.

Fuses as disclosed e.g. in U.S. Pat. No. 3,240,905 to F. J. Kozacka; Mar. 15, 1966 for LOW VOLTAGE FUSE HAVING A CASING OF CELLULOSIC MATERIAL AND AN ARC-QUENCHING FILLER OF QUARTZ SAND have a perforated fusible element of copper which may be substituted, if desired, by one of copper, and terminals in the form of blade contacts which are of copper. These terminals are not adapted to be used, nor do they suggest to be used, in the way of the tabs of the present invention, i.e. to be bent across one of the rims of the casing of the fuse to the outer surface thereof, and there conductively connected with the terminal caps of the latter.

As will be explained below in detail, the thickness of the tabs according to this invention must have a critical ratio to the thickness of the fusible element. This ratio depends primarily on the maximum degree of reduction of voltage drop to be achieved, on whether or not the requirements of the Underwriters Laboratories Inc. for Standard Class R fuses are fully met, or only approximately met, and to some extent also on the geometry of the fusible element or its heat dissipation in the surrounding pulverulent arc-quenching filler.

Another object of the invention is to provide electric fuses with a tab, or a pair of tabs, which has, or which have, a minimal effect on heat dissipation. This will be explained below in greater detail.

Still another object of this invention is to provide Underwriters Laboratories Inc. Standard Class R fuses which are inexpensive to manufacture and inexpensive to operate on account of their reduced voltage drop.

A further object of this invention is to provide cool running fuses which is likewise due to their relatively small voltage drop.

Still another object of the invention is to overcompensate by the increased thickness of the terminal tab, or tabs, or copper for the larger resistivity of copper relative to that of silver.

In this context silver means also alloys of silver having substantially the physical properties, or pre-arcing $I^2 \cdot t$ values, of what is referred to in the trade as pure silver. Similarly copper means also alloys of copper having substantially the same physical properties, or pre-arcing $I^2 \cdot t$ values, of what is referred to in the trade as electrolytic copper.

SUMMARY OF THE INVENTION

The invention refers generally to low-voltage current-limiting electric fuses and more specifically to such fuses having the time-current curves prescribed by the Underwriters Laboratories Inc. Standard Class R fuses.

This invention is concerned with electric fuses comprising a tubular housing of electric insulating material having a pair of rims, a pair of terminal caps mounted on the ends of said casing and closing said casing, a pulverulent arc-quenching filler inside said casing, a fusible element having serially arranged perforations embedded in said arc-quenching filler, having a pair of terminals and an overlay of an M-effect metal having a considerably lower fusing point than said fusible element on said fusible element.

The improvement according to this invention consists in that (a) said fusible element is of a relatively thin current-limiting sheet metal;

(b) at least one of said pair of terminals is in the form of a single tab of a relatively thick current-limiting sheet metal extending from the inside of said casing across one of said pair of rims to the outside of said casing and conductively engaged by one of said pair of terminal caps;

(c) the ratio of the thickness of said tab to the thickness of said fusible element is at least in the order of 2:1, but less than 5:1, and increases as the heat dissipation of said fusible element decreases;

(d) said tab is formed by a part separate from said fusible element; and (e) a bond electroconductively interconnecting said fusible element and said tab.

BRIEF DESCRIPTION OF THE DRAWINGS

FIG. 10 shows the increase of the heat exchange area of the connector tabs plotted against the thickness of the connector tabs of a fusible element in multiples of the thickness of its center portion;

FIG. 10*a* is an isometric view of a connector tab and a portion of the center of a fusible element wherein the ratio of the thickness of the former to that of the latter is 2:1;

FIG. 10*b* is an isometric view of a connector tab and a portion of the center of a fusible element wherein the ratio of the thickness of the former to that of the latter is 4:1;

DESCRIPTION OF PREFERRED EMBODIMENT

Figure 5:
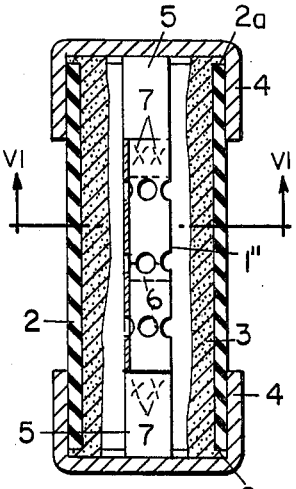
FIG. 5 is a longitudinal section of the structure of FIGS. 4 and 6 taken along V—V of FIG. 6.
Figure 6:
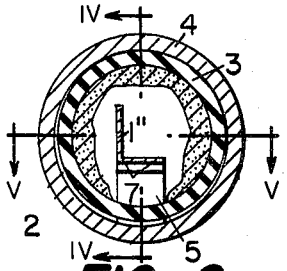
FIG. 6 is a cross-section of the structure of FIGS. 4 and 5 taken alone VI—VI of FIG. 5.
Figure 7:
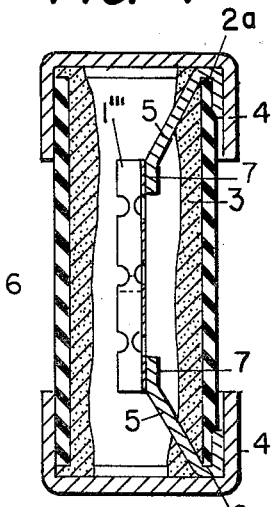
FIG. 7 is a longitudinal section of a third embodiment of this invention taken along VII—VII of FIG. 9 and rotated in such a way that the cross-section of the web of the fusible element appears on the left side of FIG. 7.
Figure 8:
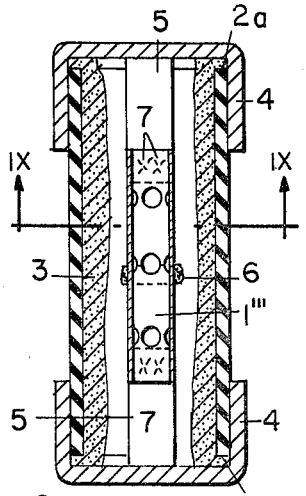
FIG. 8 is a longitudinal section of the structure of FIGS. 7 and 9 taken along VIII—VIII of FIG. 9.
Figure 9:
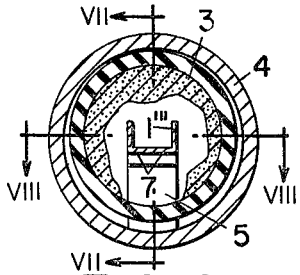
FIG. 9 is a cross-section of the structure of FIGS. 7 and 8 taken along IX—IX of FIG. 8.

The three embodiments of the invention shown in FIGS. 1–9 differ from one another only in regard to the geometry of the fusible element. The fusible element 1' of FIGS. 1–3 consists of a planar, perforated sheet preferably of silver. The fusible element 1'' of FIGS. 4–6 consists of an L-shaped perforated sheet preferably of silver having two flanges whose aggregate width is equal to the width of fusible element 1'. The fusible element 1'''of FIGS. 7–9 is substantially channel-shaped, its flange portion enclosing with its web portions acute angles up to 90 deg. Fusible element 1''' is preferably likewise of perforated sheet silver. For reasons of economy fusible elements 1',1'' and 1''' may also be of copper.

Since all figures show the same structures except for fusible elements 1',1'',1''', the same reference numerals have been applied in FIGS. 1–9 to designate like parts.

A tubular casing 2 of electric insulating material, e.g. glass-cloth-melamine, is filled with a pulverulent or particulate arc-quenching filler 3, such as quartz sand. Filler 3 has only been indicated adjacent its interface with casing 2, but actually fills the entire casing 2, except for the portions thereof that are occupied by other parts. Casing 2 has a pair of circular rims 2*a*, one on each end of casing 2. Terminal caps or ferrules 4 are mounted on each end of casing 2 and close the latter. Each of fusible elements 1',1'',1''' has a single pair of narrow tabs, or connector tabs 5, one on each end thereof.Tabs 5 extend from the inside of casing 2 across its rims 2*a* to the outer surface of casing 2. Tabs 5 are conductively engaged by the inner surfaces of terminal caps 4. They may be soldered or spot welded to caps 4, or they may be a pressure contact between tabs 5 and caps 4. An overlay 6 of an M-effect metal having a considerably lower fusing point than silver, e.g. an overlay of tin, or of an alloy containing tin, extends transversely across each of fusible elements 1',1'' and 1''', respectively.

While in the embodiments of the invention of FIGS. 1–9 the fusible elements 1',1'',1''' are of silver, the connector tabs 5 are of copper. The thickness of tabs 5 exceeds the thickness of fusible elements 1',1'',1'''. The thickness of connector tabs 5 also exceeds the additional thickness required to fully compensate for the higher resistivity of copper relative to the resistivity of silver. In other words, the thickness of tabs 5 overcompensates the higher resistivity of copper relative to that of silver. The ratio of the thickness of said pair of tabs 5 to the thickness of fusible elements 1',1'',1''' is in the range of about 2:1 to somewhat less than 5:1, the particular optimal thickness ratio depending upon the configuration of fusible elements 1',1'' and 1''' as shown in greater detail. Each pair of tabs 5 is formed by one of two parts separate from fusible elements 1',1'',1,''', respectively. As mentioned above parts 1',1'',1,''' respectively, are interconnected electroconductively to the pair of tabs 5, e.g. by spot welds. These spot welds have been indicated by reference character 7. The axially outer ends of tabs 5 that are bent around rims 2*a* are inserted into the gaps formed between casings 1 and caps 4 and, as mentioned above, conductively connected to caps 4 in one of the many ways known in the art.

Figure 1:
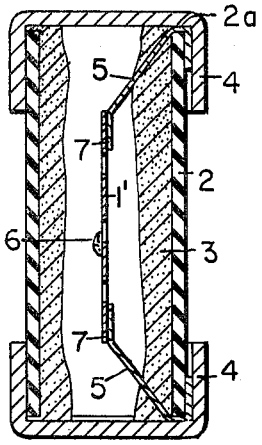
FIG. 1 is a longitudinal section along I—I of FIG. 3 showing a fuse according to the present invention.
Figure 2:
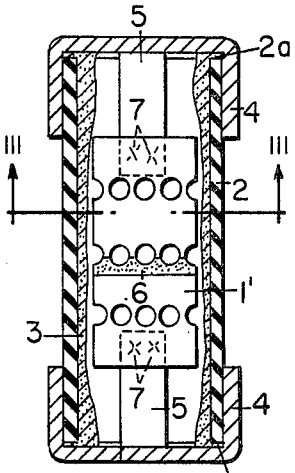
FIG. 2 is a longitudinal section along II—II of FIG. 3 of a fuse according to FIGS. 1 and 3.
Figure 3:
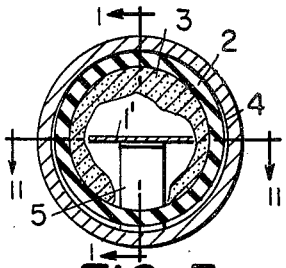
FIG. 3 is a cross-section of the structure of FIGS. 1 and 2 along III—III of FIG. 2.

One of the functions of fusible elements 1',1'',1''' is to achieve the desired time-current characteristic defined as the Standard for Class R-fuses. This can and has been achieved with various geometrics of the fusible elements. In the structure of FIGS. 1–3 the heat flow away from fusible element 1' is maximized due to its planar geometry. The fusible element 1'' dissipates less heat than fusible element 1' due to its angular shape, but heat dissipation from angular fusible element 1'' to quartz sand filler 3 is not substantially reduced. A further reduction of the heat flow from element 1''' shown in FIGS. 7–9 is achieved by its channel shape. Though the time-current curves of the embodiments of the invention shown in FIGS. 1–3, FIGS. 4–6 and FIGS. 7–9 vary, they all comply with the Standard for Class R-fuses that the minimum acceptable clearing time for time delay fuses must be 10 sec. at 500% of their rated current.

An improvement of the fuses according to this invention can be effected by reducing the ohmic resistance of tabs 5 without, or without significantly, affecting the area of tabs 5 on which the beat flow away from tabs 5 depends. This can be achieved by increasing within specified limits the thickness of tabs 5 relative to the thickness of fusible elements 1',1'',1'''.

Assuming the area of the surface of tabs 5 which determines the heat flow away from tabs 5 is roughly determined by their length l, their width w and their thickness Δt. This notation is used to express the fact that l and w are relatively large quantities, and that Δt is a relatively small quantity. The area of the surface which largely determines the heat flow away from tabs 5 is then given by the equation $$A=2(l\cdot w)+2(l+w)\cdot\Delta t.$$

If Δt is doubled, the above equation takes the form $$A+\Delta A=2(l+w)+4(l+w)\cdot\Delta t,$$

Since A is large in comparison to ΔA, a large percentagewise increase of ΔA will result in a relatively small increase A+ΔA. In other words, A remains a large constant, while ΔA is changed in the order of many percent. This has been diagrammatically illustrated in FIG. 10 where an increase of ΔA in the order of several hundred percent resulted in an increase of A+ΔA in the order of 10–20%.

The reason for the above is due to the fact that the top surfaces and bottom surfaces of tabs 5 of which each is l·w, are relatively large constants, whatever the thickness of tabs 5, and that the lateral surfaces of tabs 5 are small in relation to the top surface and bottom surface thereof. This has been illustrated isometrically in FIGS. 10*a* and 10*b*.

For example the thickness of the fusible element of silver may be 0.007", its width 10/16 of an inch and the width of each tab 5/16 of an inch. The heat exchange area A of each tab 5 is then $$\begin{aligned}&2(1\cdot w)+2(1+w)\cdot\Delta t\\&=2(1\cdot 0.3125)+2(1+0.3125)\cdot 0.007\\&=1\cdot 0.6259+1\cdot 0.014+0.0021\ \text{inch}^2.\end{aligned}$$

The first term is evidently much larger than the sum of the second and third terms.

Assuming now that the above data are not changed, except the thickness of the tabs 5, which is increased from Δt to 3Δt. Hence the heat exchange area of each tab 5 is $$\begin{aligned}&2(1\cdot w)+6(1+w)\cdot\Delta t\\&=2(1\cdot 0.3125)+6(1+0.3125)\cdot 0.007\\&=1\cdot 0.6250+1\cdot 0.042+0.0131\ \text{inch}^2.\end{aligned}$$

Also in this instance the first term is evidently much larger than the sum of the second and third term.

Summarising, the ratio of the thickness of tabs 5 to the thickness of fusible elements 1',1'',1''' must be at least in the range of 2:1, but less than 5:1, and must increase as the heat dissipated from the fusible element decreases. The closer the above thickness ratio to 5:1, the smaller the gain in voltage drop and the more difficult to handle the unit whose ends are so much thicker than its perforated center portion.

Figure 11:
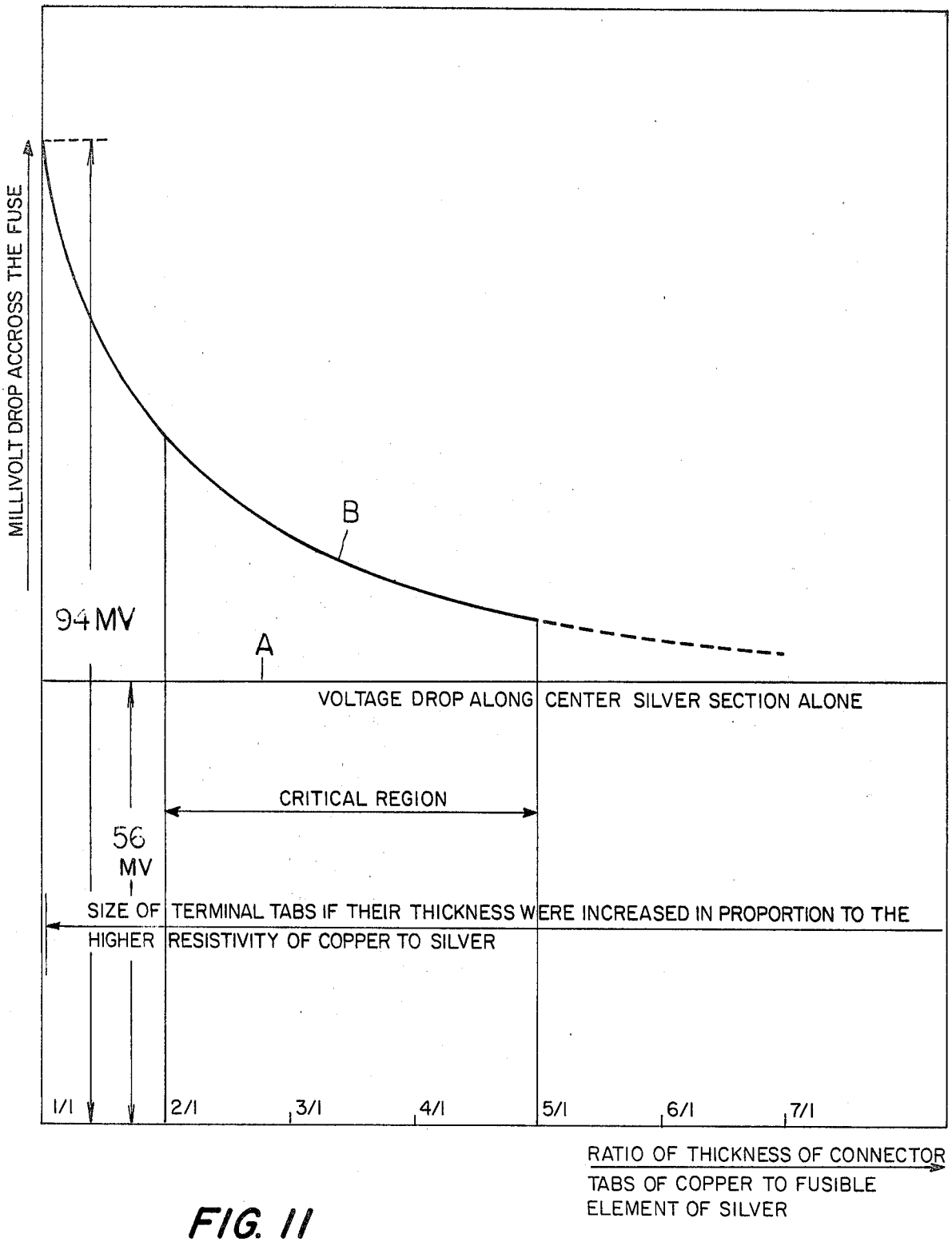
FIG. 11 shows the voltage drop across fuses embodying this invention plotted against the ratio of the thickness of the connector tabs of copper to the thickness of a fusible element of silver.

Referring now to FIG. 11, this figure shows the voltage drop of a fuse according to the invention plotted against the ratio of the thickness of the connector tabs 5 to that of fusible element 1', 1'', 1'''. The fuse has a current rating of 100 amps. and a voltage rating of 250 volt.

Line A indicates the voltage drop across the fusible element 1'', 1'', 1''' of silver, at a given current which is constant, and line B indicates the voltage drop across the entire fuse, i.e. including tabs 5. The voltage drop according to line A was 56 millivolt, and the voltage drop across tabs 5 varies downwardly from a maximum of 94 millivolt at 20 deg.C.

If tabs 5 were of silver and has the same thickness as the fusible element 1', 1'', 1''' of silver, the voltage drop across the entire fuse would be about 91 millivolts. This gain would entail increased material cost and be insignificant.

To manufacture fusible element 1', 1'', 1''' of silver and tabs 5 of copper is likewise uneconomical, as long as the thickness of tabs 5 does not substantially exceed that of fusible element 1', 1'', 1'''.

A substantial progress can be achieved if the thickness of copper tabs 5 is significantly larger than the additional thickness required to fully compensate for the higher resistivity of copper relative to the resistivity of silver. In other words, according to the present invention the higher resistivity of copper relative to that of silver is not only fully compensated but overcompensated by the increased thickness of the copper tabs 5 relative to that of the fusible element 1', 1'', 1''' of silver.

Curve B may be subdivided into three zones, one to the left, one to the right, and one at the center. In the left zone the voltage gradient is relatively high. Such fuses are relatively hot running fuses, and hence consuming large amounts of energy. In the right zone the voltage gradient is relatively small, and therefore, the gain in conductivity or decrease of voltage gradient to be achieved by thickening the terminals 5 beyond 5 times the thickness of the center portion of the fusible element is not worth while. On the contrary, while some small gain in regard to voltage drop could be achieved by thickening terminals 5 to, or beyond the 5:1 ratio, such thickening of terminals 5 would be impractical since it would greatly increase the danger of deforming the relatively thin fusible elements 1',1'',1''' of silver while performing the bending of terminals 5.

Summarizing the above for a clearer understanding of the invention, fuses according to it must have serially perforated fusible elements 1',1'',1''' of silver or copper and conductively bonded on tabs 5 of copper bent around the rims of the casing. The ratio of tab thickness to fusible element thickness is critical. It must not be less than in the order of 2:1. If less, the fuse is running hot, and not sufficient gain in voltage drop is achieved to justify manufacturing the fusible element 1',1'',1''' and its tabs 5 as separate parts. The ratio between the thickness of the tabs 5 and the thickness of the fusible element 1',1'',1''' must be less than 5:1 because a greater thickening of tabs 5 would not result in a significant decrease in the voltage drop across the fuse and result in serious manufacturing problems.

Simultaneously with meeting the above conditions relating to the ratio of tab thickness to fusible element thickness, the time-current curve conditions specified in Standard UL 198.4 must be met, and not only the time-current curve conditions, but all conditions specified in UL 198.4 as, e.g. acceptable temperature rise conditions. The latter are specified in Table 6.1 of the above Standard. However, meeting other conditions than thickness ratio and time-current curve conditions does not involve any problems and, therefore, does not need to be discussed in this context.

Among the many time-current curves specified in Table 7.1 of UL 198.4 there are a number of curves which meet both the above time-current curve conditions and the above thickness ratio conditions. These are the fuses whose time-current curves are shown in FIGS. 12 to 14.

Figure 4:
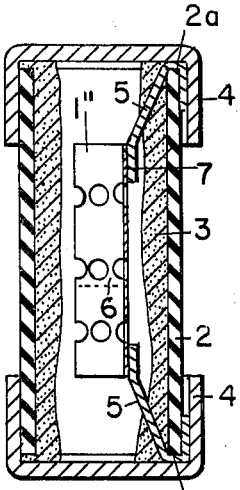
FIG. 4 is a longitudinal section along IV—IV of a second fuse embodying this invention, said section being rotated in such a way that the sectioned portion of its fusible element appears to the right side of FIG. 4.
Figure 14:
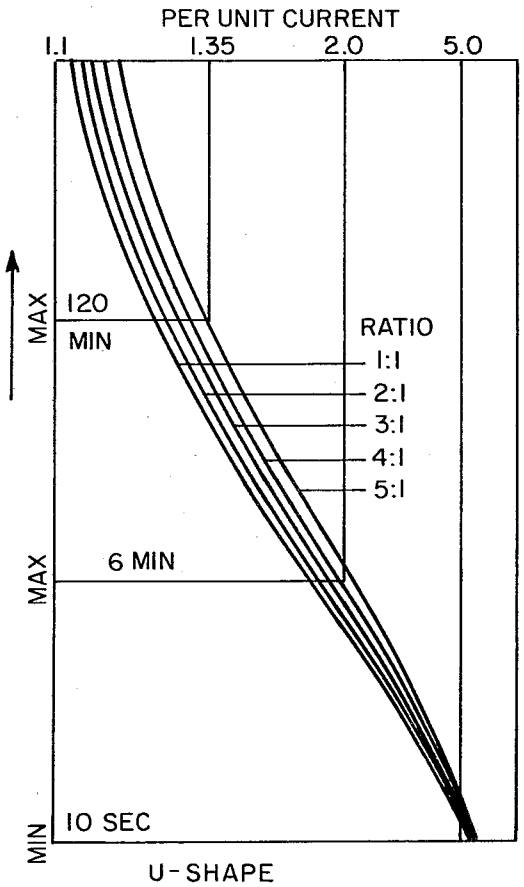
FIGS. 12 to 14 show time-current curves of fuses embodying this invention for different geometries of the fusible silver element thereof.
Figure 13:
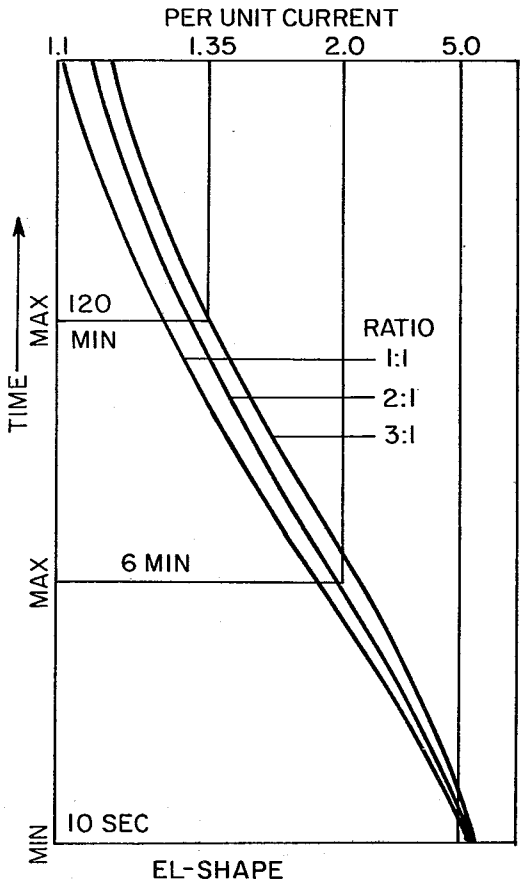
Figure 12:
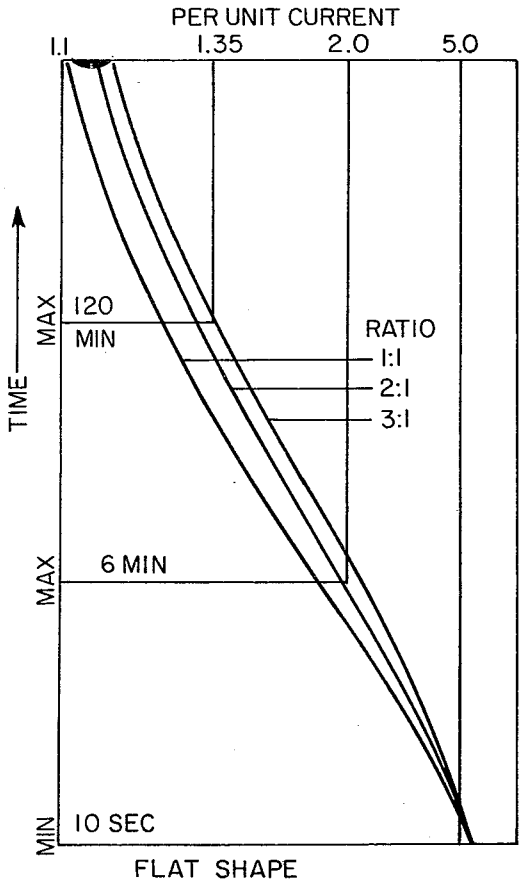

FIGS. 12 to 14 show the time-current characteristics of fuses having planar fusible elements 1' as shown in FIGS. 1–3, of fuses having L-shaped fusible elements 1'' as shown in FIGS. 4–6, and of fuses having U-shaped fusible elements as shown in FIGS. 7–9. The time-current characteristics of the fuses shown in FIGS. 12–14 were fuses having a current rating of 100 amps and a voltage rating of 250 or 600 volt. Shown in FIGS. 12 and 13 are three time-current curves having perforated center portions 1' and 1'' of silver and terminals 5 of copper and thickness ratios of the copper to the silver portions of 1:1; 2:1 and 3:1. In FIG. 14 five time current curves are shown having thickness ratios of the copper terminals 5 to the perforated fusible element 1''' of 1:1; 2:1; 3:1; 4:1 and 5:1. Current is plotted on a per unit basis, i.e. 1.1 means 110% of the rated current as defined in paragraph 5.1 of UL 198.4; and 1.35, 2.0 and 5.0 means 135%, 200% and 500% of the rated current as defined in UL 198.4; Table 7.1. The upper horizontal line Max. refers to a maximal clearing time of 120 minutes and the lower horizontal line Max refers to a maximal clearing time of 6 minutes. The lower horizontal line marked Min refers to a minimum clearing time of 10 seconds. The data correspond to the maximum and the minimum clearing times specified in Table 7.1 of UL 198.4.

It is apparent from FIGS. 12 to 14 that all eleven fuses the performance of which is shown in FIGS. 12 to 14 complied with the 110 percent current carrying capacity test of paragraph 5.1 of UL 198.4. The fuses having a ratio of terminal thickness to fusible element thickness of substantially less than 2:1 do not comply with the requirement of smallness of voltage drop and consequent smallness of heat losses (FIG. 11) and, therefore, do not qualify. The fuses having a ratio of terminal thickness to fusible element thickness of about 2:1 to 3:1 comply with both the time-current curve requirements of UL 198.4, Table 7.1 and the heat loss requirements illustrated in FIG. 11 and described in the context of the figure and are, therefore, highly desirable. All fuses the time-current curves of which are shown in FIG. 12 comply with the 500% current rating requirement of UL 198.4, Table 7.1.

Referring now to FIG. 13, all the fuses the characteristics of which are shown therein have a ratio of tab thickness to fusible element thickness of 1:1 to 3:1. Fuses wherein said ratio is less than 2:1 are hot running fuses (FIG. 11) and hence do not qualify under the cool running test. The fuses having a ratio of terminal thickness to fusible element thickness of 2:1 fully comply with the requirement of UL 198.4, Table 7.1 at 200% of the rated current. The fuses having the ratio of terminal thickness to fusible element thickness of 3:1 do not fully comply with the requirements of UL 198.4, Table 7.1 because their cleaning times at 135% and at 200% of their current rating exceeds the values specified in that Table. All the fuses the time-current curves of which are shown in FIG. 13 comply with the minimum clearing requirements of UL 198.4, Table 7.1 at currents of 500% the rated current.

All the fuses the characteristics of which are shown in FIG. 14 comply with the requirement of UL 198.4, paragraph 5.1, except the fuses having a ratio of tab thickness to fusible element thickness of 5:1. The fuses wherein said ratio is substantially less than 2:1 are unacceptable as Class R fuses because of the heat losses occurring therein. All the fuses the time-current curves of which are shown in FIG. 14 comply with the requirement of UL 198.4, Table 7.1 in regard to minimum acceptable clearing time at 500% of the rated current. the rated current.

The results of the above analysis are tabulated below, wherein 00 means excessive voltage drop, 0 means noncompliance with UL 198.4, paragraph 5.1 and/or Table 7.1 and X means acceptable.

| Planar Fusible Element (FIG. 12) | | | |
|---|---|---|---|
| | Ratio of Thickness of Copper Tab to Thickness of Fusible Element of Silver | | |
| Percent of Rated Current | 1:1 | 2:1 | 3:1 |
| 110% | 00 | X | X |
| 135% | 00 | X | 0 |
| 200% | 00 | X | 0 |
| 500% | 00 | X | X |

L-Shaped Fusible Element (FIG. 13)

| Percent of Rated Current | Ratio of Thickness of Copper Tab to Thickness of Fusible Element of Silver 1:1 | 2:1 | 3:1 |
|---|---|---|---|
| 110% | 00 | X | X |
| 135% | 00 | X | 0 |
| 200% | 00 | X | 0 |
| 500% | 00 | X | X |

U-Shaped Fusible Element (FIG. 14)

| Percent of Rated Current | Ratio of Thickness of Copper Tab to Thickness of Fusible Element of Silver 1:1 | 2:1 | 3:1 | 4:1 | 5:1 |
|---|---|---|---|---|---|
| 110% | 00 | X | X | X | X |
| 135% | 00 | X | X | X | X |
| 200% | 00 | X | X | X | 0 |
| 500% | 00 | X | X | X | X |

The millivolt drop versus the ratio of tab thickness to fusible element characteristic of FIG. 11 should, in fact, not be a line, but a band, because there are hardly any two fuses which are identical and perform in exactly the same fashion. The above fact is due to unavoidable manufacturing tolerances.

For the same reasons the eleven time-current curves of FIGS. 12 to 14 should be bands rather than simple lines.

The table below indicates the spread of the millivolt drop that occurs in a fuse having a planar fusible element as shown in FIGS. 1–3 of silver of a thickness of 0.007", a current rating of 100 amps, a volt rating of 250 volts and carrying a load current of 250 amps.

| Thickness ratio of copper tabs to fusible element | Millivolt Drop | Clearing Time in Seconds |
|---|---|---|
| 1:1 | 98 | 25 |
| | 100 | |
| | 100 | |
| | 98 | |
| 2:1 | 72 | 31 |
| | 70 | |
| | 75 | |
| | 72 | |
| 3:1 | 67 | 42 |
| | 67 | |
| | 70 | |
| | 68 | |

The table below indicates the spread of the millivolt drops across a fuse having an L-shaped fusible element as shown in FIGS. 4–6 of silver having a thickness of 0.007", a current rating of 100 amps., a voltage rating of 250 or 600 volts and carrying a load current of 250 amps.

| Thickness ratio of copper tabs to fusible element | Millivolt Drop | Clearing time in seconds |
|---|---|---|
| 1:1 | 104 | 21 |
| | 105 | |
| | 101 | |
| | 99 | |
| 2:1 | 78 | 29 |
| | 78 | 33 |
| | 76 | 35 |
| 3:1 | 68 | 34 |

-continued

| Thickness ratio of copper tabs to fusible element | Millivolt Drop | Clearing time in seconds |
|---|---|---|
| | 70 | 32 |
| | 70 | 30 |
| | 70 | 34 |
| 4:1 | 67 | 34 |
| | 70 | 32 |
| | 66 | 30 |
| | 68 | 32 |
| 5:1 | 61 | 54 |
| | 62 | 52 |

Fuses according to this invention having a tab thickness to fusible element thickness ratio of 2:1, or a little less than 2:1, may not qualify as Standard R-fuses because they do not fully meet the requirements of UL 198.4, but still may be usable, and desirable, because of their reduction in voltage drop and energy consumption. The same applies to fuses having a tab thickness to fusible element thickness ratio of, or in excess of, 5:1 whose time-current curve is shown in FIG. 14. Such fuses do not qualify as Standard R-fuses because they do not fully meet the requirements of UL 198.4, but they may still be usable, and desirable, because of their reduction in voltage drop and their low energy consumption.

Usually the term low-voltage fuses is used in connection with fuses having a voltage rating of 250 volt to 600 volt. But the present invention allows higher voltage ratings up to about 1000 volt since the same, or substantially the same, advantages apply to fuses having such voltage ratings. The fuses shown in FIGS. 1–9 have a voltage rating of 250 volt and have three serially related lines of perforations. Four serially related lines of perforations in their fusible element will enable the same fuses to clear circuits having a voltage of 600 volt.

I claim as my invention:

1. In an electric low voltage fuse having a tubular casing of electric insulating material having a pair of rims, a pulverulent arc-quenching filler inside said casing, a fusible element having serially arranged perforations embedded in said arc-quenching filler, said fusible element having an overlay of an M-effect metal having a considerably lower fusing point than the remainder of said fusible element, a pair of terminals electrically connected to said fusible element and a pair of terminal caps mounted on the ends of said casing and enclosing said arc-quenching filler, said fusible element, and said pair of terminals within said casing, the improvement comprising:

(a) at least one of said pair of terminals including a tab of uniform thickness and cross-section made of a current-limiting metal extending from the inside of said casing across one of said pair of rims to the outside of said casing, said tab including a plurality of bends therein placing a significant portion of said tab in an abutting and electrically conductive relationship with one of said pair of terminal caps, said tab being electroconductively bonded to said fusible element;

(b) said fusible element being made of a relatively thin current-limiting sheet metal; and (c) the ratio of the thickness of said tab to the thickness of said fusible element being between 2 and 5.

2. An electric low voltage fuse as specified in claim 1, wherein the other of said pair of terminals also includes a tab of uniform thickness made of a current-limiting metal extending from the inside of said casing across the other of said pair of rims to the outside of said casing, said tab including a plurality of bends therein placing a significant portion of said tab in an abutting and electrically conductive relationship with the other of said pair of terminal caps, said tab being electroconductively bonded to said fusible element and the ratio of the thickness of said tab to the thickness of said fusible element being between 2 and 5.

3. An electric low voltage fuse as specified in claim 1, wherein said tab is made of copper and said fusible element is made of silver.

4. An electric low voltage fuse as specified in claim 1 wherein the ratio of the thickness of said tab to the thickness of said fusible element is on the order of 3.

5. An electric low voltage fuse as specified in claim 4 wherein said fusible element is in the shape of a channel having an axially extending web portion and axially extending flange portions that enclose with said web portion acute angles up to 90 degrees, and wherein said bond between said fusible element and said tab is located at one end of said web portion.

6. In an electric low voltage fuse having a time-current curve as specified by Underwriters Laboratory Inc. as a requirement for a Standard Class R fuse and having a tubular casing of electric insulating material having a pair of rims, a pulverulent arc-quenching filler inside said casing, a fusible element having serially arranged perforations embedded in said arc-quenching filler, said fusible element having an overlay of an M-effect metal having a considerably lower fusing point than the remainder of said fusible element, a pair of terminals electrically connected to said fusible element and a pair of terminal caps mounted on the ends of said casing and enclosing said arc-quenching filler, said fusible element and said pair of terminals within said casing, the improvement comprising:

(a) at least one of said pair of terminals including a tab of uniform thickness and cross-section made of a current-limiting metal extending from the inside of said casing across one of said pair of rims to the outside of said casing, said tab including a plurality of bends therein placing a significant portion of said tab in an abutting and electrically conductive relationship with one of said pair of terminal caps, said tab being electroconductively bonded to said fusible element;

(b) said fusible element being made of a relatively thin current-limiting sheet metal; and (c) the ratio of the thickness of said tab to the thickness of said fusible element being between 2 and 5.

7. An electric low voltage fuse as specified in claim 6, wherein the other of said pair of terminals also includes a tab of uniform thickness made of a current-limiting metal extending from the inside of said casing across the other of said pair of rims to the outside of said casing, said tab including a plurality of bends therein placing a significant portion of said tab in an abutting and electrically conductive relationship with the other of said pair of terminal caps, said tab being electroconductively bonded to said fusible element and the ratio of the thickness of said tab to the thickness of said fusible element being between 2 and 5.

8. An electric low voltage fuse as specified in claim 6, wherein said tab is made of copper and said fusible element is made of silver.

9. An electric low voltage fuse as specified in claim 6 wherein the ratio of the thickness of said tab to the thickness of said fusible element is on the order of 3.

10. An electric low voltage fuse as specified in claim 9 wherein said fusible element is in the shape of a channel having an axially extending web portion and axially extending flange portions that enclose with said web portion acute angles up to 90 degrees, and wherein said bond between said fusible element and said tab is located at one end of said web portion.

* * * * *